United States Patent [19]

Kind

[11] Patent Number: 4,763,792

[45] Date of Patent: Aug. 16, 1988

[54] DEVICE FOR SORTING OUT METAL PARTICLES

[75] Inventor: Guntram Kind, Gummersbach, Fed. Rep. of Germany

[73] Assignee: Pulsotronic Merten GmbH & Co. KG, Gummersbach, Fed. Rep. of Germany

[21] Appl. No.: 901,561

[22] Filed: Aug. 28, 1986

[30] Foreign Application Priority Data

Sep. 19, 1985 [DE] Fed. Rep. of Germany ..... 3533390

[51] Int. Cl.[4] ..... B07C 5/344; B07C 5/36

[52] U.S. Cl. ..... 209/570; 209/643; 209/906

[58] Field of Search ..... 209/567, 570, 571, 643, 209/656, 657, 906, 915, 925; 406/3, 83, 84, 155, 156, 163, 173, 174, 183

[56] References Cited

U.S. PATENT DOCUMENTS

| | | | |
|---|---|---|---|
| 1,074,743 | 10/1913 | Roberts | 406/83 |
| 3,283,899 | 11/1966 | Vedvik et al. | 209/571 X |
| 3,326,609 | 6/1967 | Auten et al. | 406/183 X |
| 4,171,262 | 10/1979 | Lattmann et al. | 209/570 X |
| 4,480,753 | 11/1984 | Thomas et al. | 209/570 X |

FOREIGN PATENT DOCUMENTS

| | | | |
|---|---|---|---|
| 2032993 | 1/1972 | Fed. Rep. of Germany | 209/571 |
| 0145374 | 12/1980 | Fed. Rep. of Germany | 209/570 |
| 2944192 | 5/1981 | Fed. Rep. of Germany | 209/567 |
| 3323162 | 1/1985 | Fed. Rep. of Germany | 209/570 |
| 0574585 | 7/1924 | France | 209/571 |

*Primary Examiner*—Robert B. Reeves
*Assistant Examiner*—Edward M. Wacyra
*Attorney, Agent, or Firm*—Spensley Horn Jubas & Lubitz

[57] ABSTRACT

A device for sorting out metal particles from a current of conveyed material, such as grinding stock or granular material, including a retarding device in the form of a whirling chamber between a metal detector and a sorting device.

21 Claims, 3 Drawing Sheets

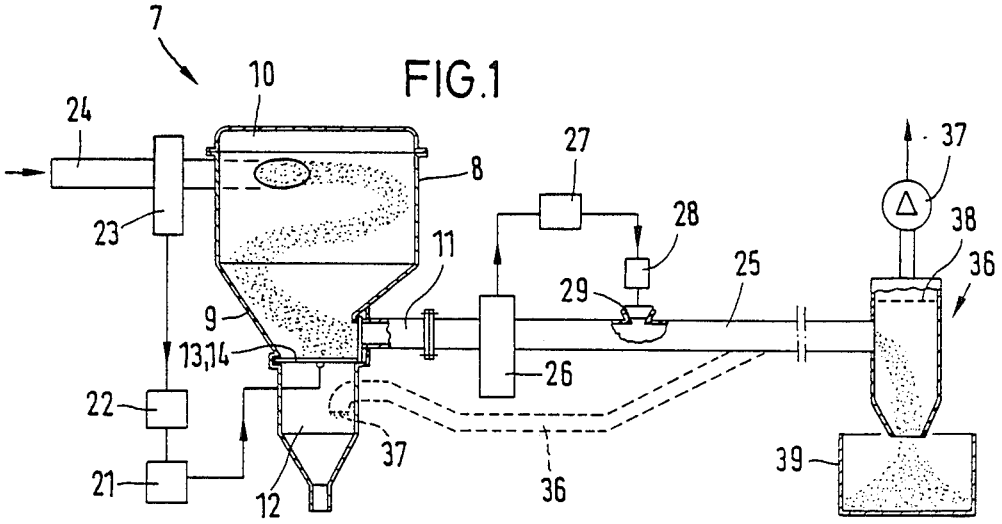
FIG.1
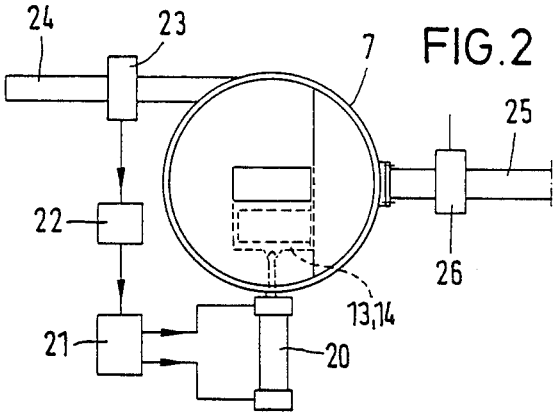
FIG.2
FIG.3
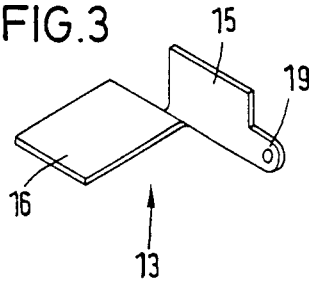
FIG.4
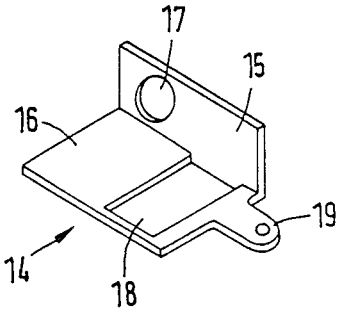

DEVICE FOR SORTING OUT METAL PARTICLES

BACKGROUND OF THE INVENTION

1. Field of the Invention

The invention relates to a device for sorting out metal particles from a current of conveyed material such as grinding stock or granular material.

2. Description of Related Art

A sorting device is known (from European Patent Publication No. 0 143 231) in which a retardation means is formed by including at least one deviation or elbow in the conveying line between a metal detector and a sorting means. One advantage of this known device is that the building length may be reduced, whereby a compact unit is obtained which may be fully accommodated in a handy housing. Such a device may be easily incorporated in a suction or pressure feeding system. Due to the relatively sharp curve of the feed pipe, however, accumulations of the conveyed material may pile up in the device. Further, because the device must be mounted vertically, it creates a significant mismatch between the incoming and outgoing portions of a horizontal feed pipe. This mismatch may be only compensated for by the addition of a number of pipe elbows. Therefore, if the feed pipe is laid, particular attention must be paid to this fact in order to avoid accumulations in the feed pipe.

It is an object of the present invention to improve a device of the foregoing type concerning the retardation means, and, above all, to avoid accumulations of the conveyed material in the system.

SUMMARY OF THE INVENTION

In accordance with the present invention, these and other objectives are achieved by providing a whirling chamber for whirling conveyed material so that the frictional losses are relatively low. Whirling may be performed in an extremely turbulent or directionally controlled manner, e.g. in a spiral or helical sense. As a result thereof, a non-guided advance of the conveyed material is realised due to which its residence time in the whirling chamber is longer than in case of a straight pipe layout. By said measures, conveyed material is prevented from accumulating in the system.

The whirling chamber may consist of a cylindrical top portion and a funnel-shaped lower portion, the current of conveyed material being introduced tangentially into the cylindrical portion. Due to the centrifugal and gravity force acting on the material current, a twist flow is produced by which the feed path of the conveyed material is extended so that the metal detector may be provided in the direct vicinity of the whirling chamber.

A funnel may serve as a collector of the conveyed material thus ensuring a continuous feed through the conveyor tube. In accordance with one embodiment of the invention in which the ejector tube is connected to the end of the funnel-shaped portion, on the other hand, detected feed material contaminated by metal particles may get off the system in free fall. But it is readily feasible to join to the ejector tube, via a discharge container, a suction means to accelerate the separating operation and to inhibit, for instance in case of suction feeding, that air may penetrate into the feed pipe to interfere with the feeding operation. Moreover, it is also possible to design the ejector tube and the discharge container as a bypass to the feed pipe thus doing away with an additional suction means.

Favorable mounting conditions for the sorting means may be specified in which the ejector tube and the conveyer tube meet in a direct vicinity.

By means of an angular slide used as a sorting out means, the functional safety of the apparatus is improved, because the slide is mounted transversely to the material current thus inhibiting conveyed material or metal particles from settling in the sorting device. Both connecting pieces while being controlled by one slide each, are actuated by one common drive.

The separating operation is improved by the configurations according to claims 8 and 9. Further, the relatively large aperture of the ejector tube may be used simultaneously for inspecting or cleaning the feed pipe.

The whirling chamber design of claim 11 allows to assemble in one plane without a mismatch the incoming and outgoing elements of the feed pipe.

If, contrary to expectation, a metal particle, rather than being sorted out by the sorter, is allowed to get into the feed pipe, a second metal detector, opens the air inlet valve thus causing in the outgoing portion of the feed pipe a breakdown of the feeding activity to stop. In such a case, said metal particle may be removed from the ejector tube by, for example, a scraper or broom.

BRIEF DESCRIPTION OF THE DRAWINGS

Several embodiments of the invention will be explained hereunder in more detail with reference to the drawings in which FIG. 1 is a first embodiment of the apparatus comprising a cyclon-type construction of the whirling chamber, FIG. 2 is a plan view of the whirling chamber the cover of which is open, FIG. 3 shows an angular slide, FIG. 4 shows another angular slide.

DESCRIPTION OF THE PREFERRED EMBODIMENT

Figure 5:
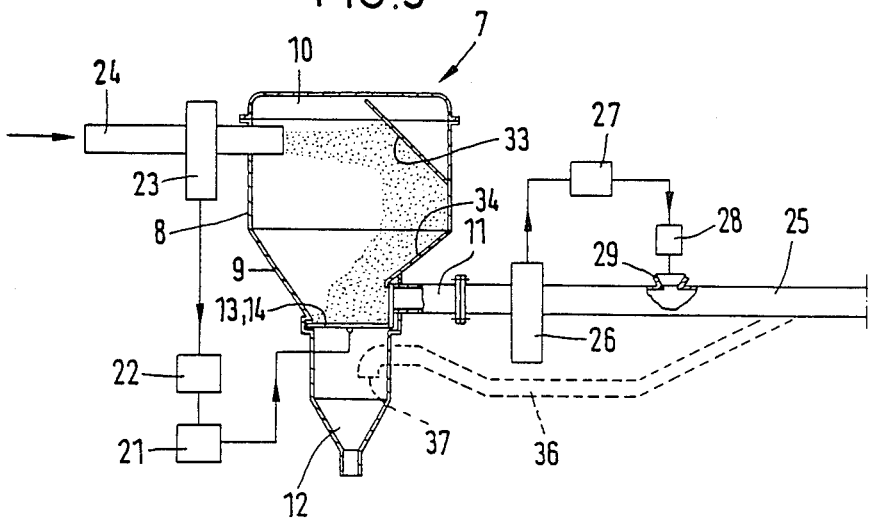
FIG. 5 shows another embodiment of the apparatus for horizontal insertion of the conveyed material into the whirling chamber.

The following detailed description is of the best presently contemplated mode of carrying out the invention. This description is not to be taken in a limiting sense, but is made merely for the purpose of illustrating the general principles of the invention. The scope of the invention is defined by the appended claims.

The apparatus illustrated in the Figs. of the drawing is used for sorting out metallic impurities such as chips, screws, nuts or the like contained in powdery, granular or lumpy material to be conveyed such as flour, sugar, pellets or granulate.

The apparatus consists of a whirling chamber generally designated with 7 and including an upper cylindrical portion 8 and a lower funnel-shaped portion 9, the upper cylindrical portion 8 being closed by a cover 10 while the lower funnel-shaped portion 9 is adjoined by an angular member consisting of the conveyer tube 11 and the ejector tube 12, the conveyer tube 11 being branched off horizontally and the ejector tube 12 extending vertically. Both members 11, 12 which include an angle of 90° are outgoing in direct vicinity from the funnel-shaped portion 9. In the angle formed by the opening cross sections, a sorting means is provided in the form of an angular slide 13, 14.

One leg 15 of the angular slide 13, 14 controls the opening of the conveyer tube 11, while the other leg 16 controls the opening of the ejector tube 12. As illustrated in FIG. 3, the two legs 15, 16 of the angular slide are mutually offset in sliding direction, with the result that, if leg 16 closes the ejector tube 12, conveyer tube 11 is left open and vice versa; if leg 15 closes the conveyer tube 11, the ejector tube 12 is left open. In case of the angular slide of FIG. 4, legs 15, 16, while being in alignment with each other, include apertures 17, 18 which are mutually offset to alternatingly open sections 11, 12.

Through hinge 19, the slide 13 or 14 is connected to the operating mechanism 20 which may be a hydraulic or pneumatic cylinder or an electromagnet (solenoid) whose servo member engages the angular slide, the operating mechanism 20 being actuated by control unit 21 which may be a hydraulic, pneumatic or magnetric valve or a switch. The control unit 21 contains an electric input connected to the evaluating unit 22 of the metal detector 23 which is an inductively operative device having an aperture penetrated by an electromagnetic ac field. By means of said aperture, the metal detector 23 is placed on the non-metallic introductory socket 24 of the feed pipe so that the cross section of said socket 24 is also penetrated by the electromagnetic ac field.

Feed section 11 is joined to feed line 25 connected via the separator 36 to a suction means 37, e.g. a suction blower. The separator 36 contains a filter 38 allowing air to pass, while being impermeable to the conveyed material dropping from the separator 36 into a collector vessel 39.

If a metal particle is present in the conveyed material, the output of the metal detector supplies a signal to the evaluating means in which the output signal of the metal detector is converted into a switch signal actuating the control unit 21 which enables the actuating mechanism 20. As a result, the angular slide 13, 14 is caused to leave its initial position in which its leg 16 closes the ejector tube 1 2, while its opening 17 releases the conveyer tube, to change into the second end position in which leg 15 closes conveyer tube 11, while ejector tube 12 is opened. Thus, the current of conveyed material is interrupted for some time in which the conveyed material with the metal particles present in the whirling chamber 7 is discharged through ejector tube 12.

By a respective guiding of the conveyed material in the whirling chamber 7, a retardation effect is realised which, in its result, corresponds to a reduction of the feeding speed or reaction time. In fact, the metal detector 23 may be placed more closely to the sorting means (angular slide) than in case of a straight feeding path. As obvious from the Figures, metal detector 23 is positioned directly adjacent the whirling chamber 7 which, together with the socket 24 and metal detector 23 may form one constructional unit. The introductory socket 24 is located at the upper edge of the cylindrical portion 8 of the whirling chamber 7, and a free twist flow or turbulence may develop intermediate socket 24 and socket 11.

The conveyer tube 11 is joined to the feed line 25 on which is placed another metal detector 26 corresponding to metal detector 23 and actuating through evaluating means 27 and control unit 28 a secondary air valve 29 mounted in the feed line 25 in spaced relationship to the metal detector 26. Should, contrary to expectation, a metal particle get through the conveyer tube 11 into the feed line 25, a signal is generated by said particle in the metal detector 26 to open the secondary air valve 29. In the part between feed pipe 11 and secondary air valve 29, feeding is interrupted. In this case, the pipe length may be emptied e.g. through the ejector tube 12. Further, one may additionally provide in the feed line 25 a non-illustrated maintenance flap. In view of said specific maintenance duties, the cross section of the ejector tube 12 is larger than that of the feed pipe 11, and it may be for instance of a rectangular design, such as shown in FIG. 2. The corresponding aperture 18 in the angular slide 14 may be rectangular as well.

In the embodiment of FIGS. 1 and 2, a twist flow is achieved by tangential arrangement of the introductory socket 24. A helically shaped turbulence develops in the conveyed material with a more or less feedstock-free core inside the whirling chamber 7.

In the embodiment of FIG. 5 of the invention, there are provided baffle or guide faces 33, 34 along which the conveyed material is rerouted or whirled. In this embodiment, the introductory socket 24 may extend radially to the whirling chamber 7.

Figure 6:
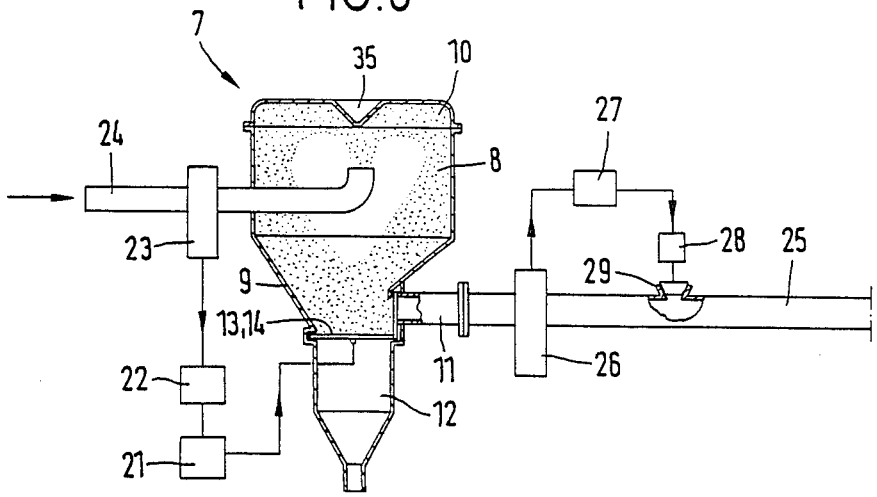
FIG. 6 is a third embodiment of the apparatus for vertically introducing the conveyed material into the whirling chamber.

In the embodiment of FIG. 6, the conveyed material is thrown through the introductory socket 24 and vertically upwardly against the cover 10, which serves as a baffle plate, thus producing a strong turbulence. By suitable guide faces 35 (cones), a large area distribution of the conveyed material may be achieved in the whirling chamber 7.

As a rule, the feed current is interrupted if the conveyer tube is closed by slide 13, 14, or if the separating operation is just in course. In other words, while the whirling chamber 7 is emptied, the conveyed material already present in the feed pipe remains ahead of the whirling chamber. Upon termination of the separating operation, the vacuum must be newly built up in the feed pipe ahead of the whirling chamber before the feeding may be started again. This may entail a clogging of the line. To continuously maintain the feeding operation, a suction pipe 36 may be connected to the ejector tube 12 to keep, via a corresponding suction means, the vacuum in the feed pipe ahead of the system, whereby it is ensured, also during the separation, that feeding is continued as far as into the whirling chamber 7. As shown in FIGS. 1 and 5, the suction pipe 36 may be connected directly to the feed pipe 25. To prevent the material from returning from the ejector tube 12 into the feed pipe 25, a screen 37 is fitted in front of the suction pipe 36.

Figure 7:
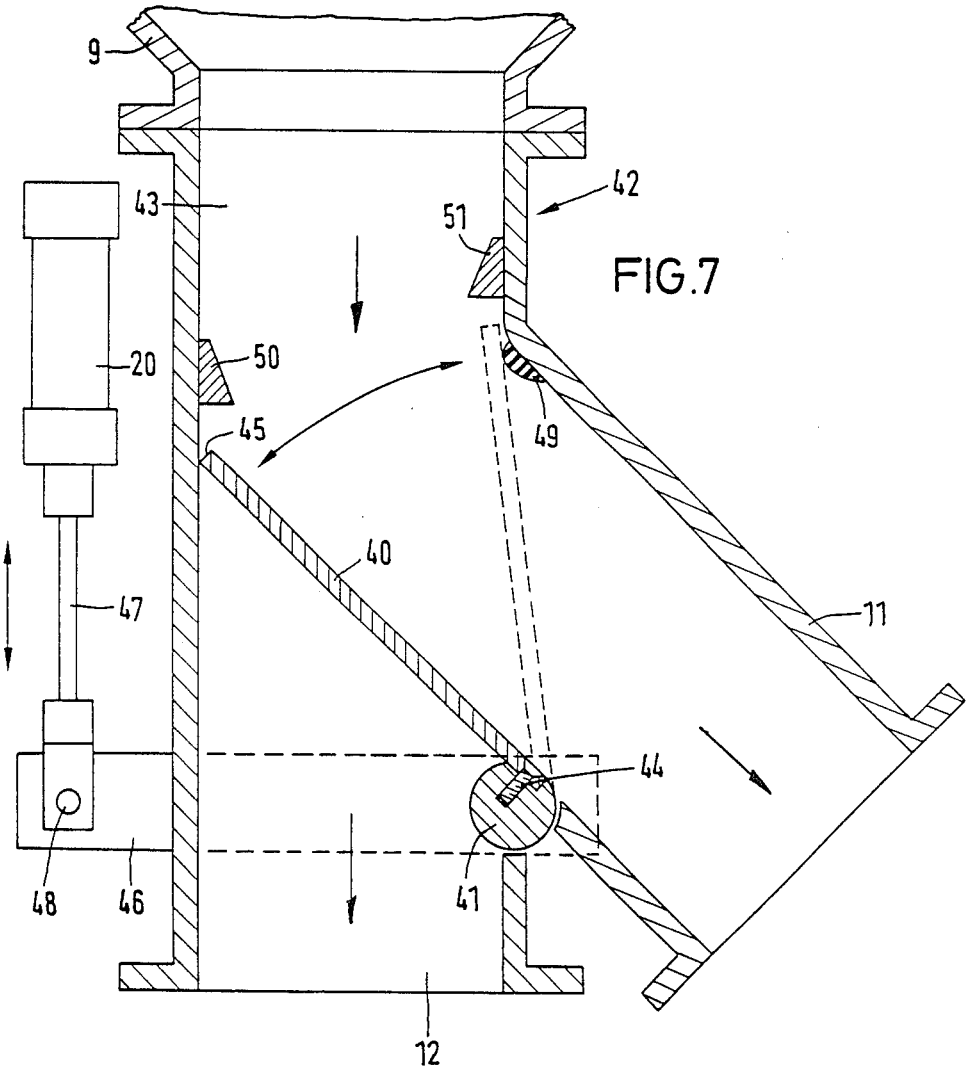
FIG. 7 is a section of a sorting means with flap.

FIG. 7 shows an embodiment in which the sorting means contains a flap 40 which, between a first position drafted in solid lines, and a second position drafted in broken lines, in pivotal about shaft 41. The funnel-shaped portion 9 is joined by an Y-shaped pipe branch 42 from the inlet region 43 of which the ejector tube 12 extends rectilinearly while the conveyer tube 11 is branched off obliquely, e.g. at an angle of about 30°. In the connection area of the two elements 11 and 12, there is supported shaft 41 to which plate 40 is secured tangentially by screws 44. In the first position in which the granular material is conveyed from the inlet region 43 to the conveyer tube 11, the flap closes the ejector tube 12 in extending in parallel to the walls or the axis of the conveyer tube 11. The external final edge 45 of the flap 40 adjoins the rectilinear continuous wall of inlet region 43 or ejector tube 12 so that the flap 40 extends obliquely in advance of the ejector tube 12. The end of flap 40 averted from the final edge 45 is fixed to shaft 41.

One end of shaft 41 is integrally connected to a lever arm 46 whose one end engages the piston rod 47 of the actuating mechanism 20 provided in the form of a piston-cylinder-unit. If the piston rod 27 is withdrawn, lever 46 is swivelled clockwise about shaft 41 as shown in FIG. 7, whereby shaft 41 is rotated and flap 40 occupies the second position illustrated in broken lines, in which the conveyer tube 11 is closed while the ejector tube 12 is released. The outer end region of flap 40 adjoins a seal 49 secured to the wall of the conveyer tube 11. In the second position of the flap 40, it extends substantially parallel to the walls or axis of the ejector tube 12.

Deflectors 50, 51 provided at opposite walls of the inlet range 43 project beyond the final edge 45 in the first and second position of flap 40 to inhibit granular material accumulation by the final edge 45.

The cross section of all pipes of branch 42 is rectangular, the same applies to flap 40 accordingly. The length of flap 40 is superior to the width of pieces 11 and 12 whose cross sections are equal. It is possible to use other cross sectional shapes in place of rectangular tube cross sections. If circular pipes are used, the flap 40 would be shaped elliptically.

What is claimed is:

1. A device for sorting out metal particles from a current of conveyed material such as grinding stock or granular material comprising:

a metal detector mounted in a conveyer line for scanning contactlessly the current of conveyed material in view of metal particles, a sorting means provided downstream of the metal detector in feeding direction and being reversible between two end positions to open in one end position a conveyer tube and in the other end position an ejector tube of the system, and an actuating system enabled by the metal detector to control the sorting means responsive to the signals of the metal detector so that, with the detection of a metal particle by the metal detector, the current of conveyed material is directed temporarily through the ejector tube and, after the metal particle has been removed, is redirected into the conveyer tube, a retardation means being provided in the current of conveyed material intermediate the metal detector and the sorting means, wherein the retardation means includes a whirling chamber having an inlet and an outlet and being configured to direct said current of conveyed material in a substantially continuous, helical flow from said inlet to said outlet, whereby the feeding time of the conveyed material is extended for a predetermined period of time.

2. A device according to claim 1, wherein the whirling chamber is of a cyclone-shaped design.

3. A device according to claim 1, wherein the substantially continuous, helical flow of the conveyed material is trapped in a funnel-shaped portion of the whirling chamber to be guided into the conveyer tube provided transversely, preferably at an angle of 90° relative to the longitudinal axis of the whirling chamber.

4. A device according to claim 3, wherein the ejector tube is connected to the end of the funnel-shaped portion towards the longitudinal axis of the whirling chamber.

5. A device according to claim 4, wherein the ejector tube and the conveyer tube extend at right angles relative to each other from the funnel-shaped portion.

6. A device according to claim 1, wherein the sorting means contains a flap pivotal about a shaft to close in a first position the ejector tube and to release the conveyer tube, and to release in a second position the ejector tube while the conveyer tube extends obliquely from the inlet region of the sorting means, while the ejector tube is joined rectilinearly to the inlet region, and that the flap in the first position extends substantially in parallel to the conveyer tube and in the second position substantially in parallel to the ejector tube.

7. A device according to claim 6, wherein in the inlet region in front of the points where the final edge of the flap is situated in the first and in the second position, deflectors projecting beyond the final edge are arranged on the walls of the inlet region.

8. A device according to claim 1, wherein the ejector tube has a cross section greater than that of the conveyer tube.

9. A device according to claim 1, wherein the substantially continuous, helical flow is generated by baffle or guide elements mounted in the whirling chamber.

10. A device according to claim 1, wherein a suction means is connected via a suction pipe to the ejector tube.

11. A device according to claim 10, wherein the suction pipe is connected to a portion of the feed line joined to the suction means.

12. A device for sorting out metal particles from a current of conveyed material such as grinding stock or granular material comprising:

a metal detector mounted in a conveyor line for scanning contactlessly the current of conveyed material in view of metal particles, a sorting means provided downstream of the metal detector in feeding direction and being reversible between two end positions to open in one end position a conveyor tube and in the other end position an ejector tube of the system, and an actuating system enabled by the metal detector to control the sorting means responsive to the signals of the metal detector so that, with the detection of a metal particle by the metal detector, the current of conveyed material is directed temporarily through the ejector tube and, after the metal particle has been removed, is redirected into the conveyor tube, a retardation means being provided in the current of conveyed material intermediate the metal detector and the sorting means, wherein the retardation means includes a whirling chamber in which a twist or turbulence flow is produced to extend the feeding time of the conveyed material, wherein the sorting means is an angular slide having two legs forming an angle and adapted to either close the ejector tube or the conveyer tube, the one leg being assigned to the aperture of the ejector tube, while the other leg is assigned to the aperture of the conveyer tube.

13. A device according to claim 12, wherein each leg includes a passageway offset mutually in the travel sense of the angular slide.

14. A device for sorting out metal particles from a current of conveyed material such as grinding stock or granular material comprising:

a metal detector mounted in a conveyor line for scanning contactlessly the current of conveyed material in view of metal particles, a sorting means provided downstream of the metal detector in feeding direction and being reversible between two end positions to open in one end position a conveyor tube and in the other end position an ejector tube of the system, and an actuating system enabled by the metal detector to control the sorting means responsive to the signals of the metal detector so that, with the detection of a metal particle by the metal detector, the current of conveyed material is directed temporarily through the ejector tube and, after the metal particle has been removed, is redirected into the conveyor tube, a retardation means being provided in the current of conveyed material intermediate the metal detector and the sorting means, wherein the retardation means includes a whirling chamber in which a twist or turbulence flow is produced to extend the feeding time of the conveyed material, wherein in the feed direction downstream of the whirling chamber, the current of conveyed material is scanned for metal particles by a second metal detector mounted in the feed line to actuate, upon detection of a metal particle not removed through the ejector tube, an air inlet valve mounted in the feed line in conveying direction downstream of the second metal detector.

15. A device for separating metallic particles from a current of metallic and non-metallic particles comprising:

a conduit through which said current may flow;

a current retardation means interposed in said conduit for extending for a predetermined period the length of time that said current remains in said conduit, said current retardation means including an inlet and an outlet and being configured to direct said current in a substantially continuous, helical flow from said inlet to said outlet;

said current retardation means further having an ejection outlet and a sorter for selectively directing said current to said ejection outlet;

a detector for detecting the presence of one or more metallic particles in said current prior to the introduction of said metallic particle in to said retardation means, and for generating a signal in response thereto;

said sorter being responsive to said signal to thereby direct said current to said ejection outlet upon the detection of a metallic particle.

16. A device as in claim 15 wherein said retardation means comprises means for imposing a turbulent flow upon said current to thereby extend the length of time that said current remains in said conduit.

17. A device as in claim 15 wherein said ejection outlet is substantially perpendicular to said conduit.

18. A device as in claim 15 wherein said sorter further comprises means for selectively closing said conduit to thereby prevent the flow of said current through said conduit and means for selectively closing said ejection outlet to thereby prevent the flow of said current through said ejection outlet.

19. A device as in claim 18 wherein said sorter comprises a substantially planer first leg and a substantially planer second leg, said first leg and said second leg being substantially mutually perpendicular.

20. A device as in claim 15 further comprising a second detector for detecting the presence of one or more metallic particles in said current subsequent to the introduction of said metallic particle into said retardation means, and for generating a second signal in response thereto.

21. A device as in claim 20 further comprising suction means in communication with said conduit and responsive to said second signal for removing said metallic particle from said conduit in response to said second signal.

* * * * *